United States Patent [19]

Banner et al.

[11] 4,445,558

[45] May 1, 1984

[54] BARKING DRUM AND METHOD

[75] Inventors: Kurt A. Banner, Gothenburg; Sten-Åke Gustafsson, Edsvalla, both of Sweden

[73] Assignee: AB Karlstads Mekaniska Werkstad, Karlstad, Sweden

[21] Appl. No.: 470,708

[22] Filed: Feb. 28, 1983

[30] Foreign Application Priority Data

Mar. 19, 1982 [SE] Sweden ..... 8201763

[51] Int. Cl.[3] ..... B27L 1/00

[52] U.S. Cl. ..... 144/341; 144/2 Z; 144/208 B; 241/183

[58] Field of Search ..... 144/208 R, 208 B, 340, 144/341; 241/152 R, 183, 76

[56] References Cited

U.S. PATENT DOCUMENTS 4,369,823 1/1983 Gustafsson ..... 144/340

OTHER PUBLICATIONS

"The Full-Tree Billerud Method," Published in Svenska Travaru- OCH Pappersmassetidning, No. 4, 1982, pp. 252-263.

*Primary Examiner*—W. D. Bray

*Attorney, Agent, or Firm*—Bell, Seltzer, Park & Gibson

[57] ABSTRACT

In order to enable a satisfactory degree of barking when removing the limbs and bark from wood in a barking drum having internally a plurality of log lifters and a plurality of slots arranged around and along the drum for the discharging of waste material freed, said drum comprising two axially aligned drum halves each comprising a main treatment section with a transition section located between them, said transition section is provided with a separating section comprising an arresting surface for the waste material and an annular outlet opening cooperating with the arresting surface and arranged in the dividing plane between the two drum halves, for discharging limbs and bark caught by the arresting surface.

13 Claims, 8 Drawing Figures

BARKING DRUM AND METHOD

FIELD OF THE INVENTION

The present invention relates to improvements in a barking drum for removing waste material, such as limbs and bark, from forest raw material being fed through the drum. More particularly the barking drum is of the type which comprises a horizontal, rotatable drum, open at both ends, and supported by bearings, said drum having a plurality of log lifters arranged inside the drum and extending along the axis of the drum, and a plurality of slots arranged around and along the drum for the discharging of waste material being freed from forest raw material under treatment in the drum. The drum comprises two or more axially aligned drum units, each comprising a main treatment section, wherein two drum units arranged after each other have end sections facing each other and comprising a transition section.

BACKGROUND OF THE INVENTION AND PRIOR ART

A barking drum of the general type defined above is described in Applicant's U.S. Pat. No. 4,369,823, issued Jan. 25, 1983. The barking drum described therein is the first of its kind enabling full trees to be treated so that the limbs and bark are removed during passage of the wood through the drum. The expression "full trees" means such trees which have not been limbed and barked, and are free or substantially free of root portions.

When removing the limbs and bark from the full trees, this is usually performed by feeding them into the drum in bundles of about 5 solid $m^3$ biomass. Of this, about 35–45% is reject material, i.e. waste material in the form of limbs, needles, leaves and bark. In order to achieve an even better barking result with this known drum, it is therefore necessary to remove rejects from the first main treatment section in which most of the limbing is carried out, before the wood is passed on to the next main treatment section in which remaining bark is to be removed.

A particular problem arises when barking forest raw material from which the bark is difficult to remove, such as eucalyptus, since the bark is stripped from the wood in such lengths which are difficult to remove from the drum.

SUMMARY OF THE INVENTION

The object of the present invention is to improve the efficiency of such a known barking drum and thus to further increase the capacity of the barking drum, and to create opportunities for increasing the applications for the barking drum so that in addition to full trees and roundwood, it can also treat other forest raw material such as eucalyptus and the like, from which the bark is difficult to remove.

This object is achieved according to the present invention in that said transition section comprises a separating means including an arresting means and an annular outlet opening cooperating with said arresting means, said outlet opening being arranged in the dividing plane between said two drum units, for discharging waste material caught by said arresting means.

The arresting means preferably has an inner edge the diameter of which is less than the diameter of the opening of the subsequent drum unit, the difference between these diameters being between about 0.1 m and 1 m.

According to a preferred embodiment of the barking drum, the two cylindrical main treatment sections have substantially the same diameter, the transition section comprises a conical section tapering in the direction of feed of the wood and forming the opening of the upstream drum unit at said dividing plane.

The width of the drainage opening is generally about 5 to 15 cm, preferably between 8 and 12 cm, most preferred about 10 cm.

It is also preferred to provide the barking drum with a conical discharge section, arranged to provide the desired degree of filling in the drum unit concerned.

As used herein the term "limbs" also includes branches and twigs.

The invention will be described in more detail in the following with reference to the accompanying drawings.

DESCRIPTION OF THE ILLUSTRATED EMBODIMENT

Figure 3:
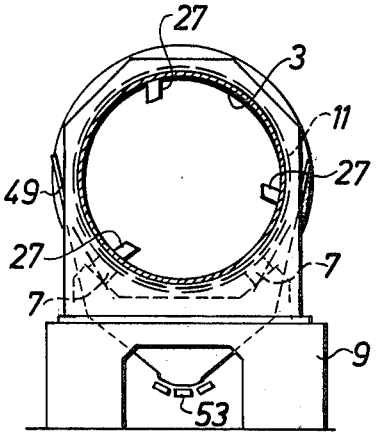
FIGS. 3 to 5 are cross sections along the lines III—III, IV—IV and V—V, respectively in FIG. 1.
Figure 4:
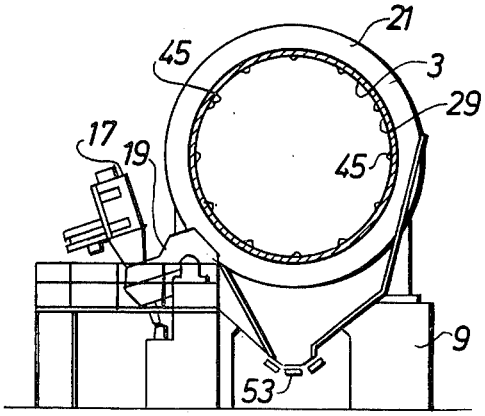
Figure 5:
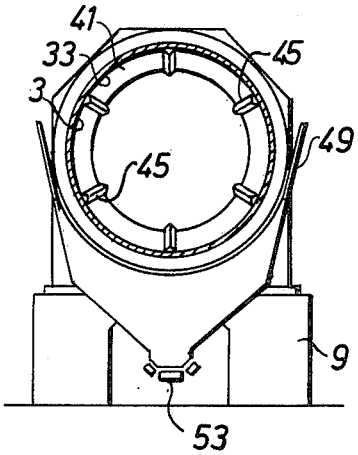
Figure 6:
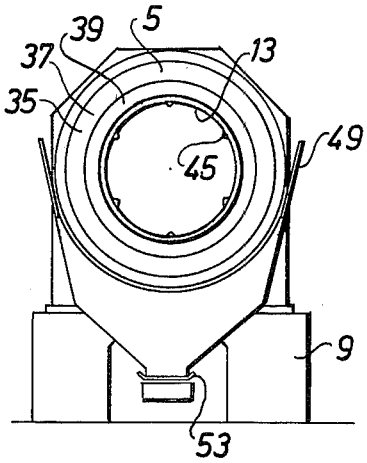
FIG. 6 is an end view of the drum according to the line VI—VI in FIG. 1.
Figure 7:
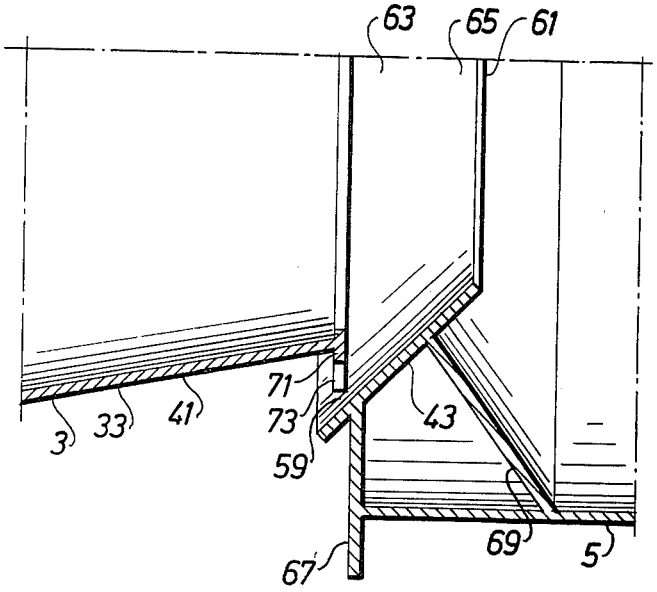
FIG. 7 is a longitudinal section of a part of a transition section in the drum according to FIGS. 1 and 2.

The barking drum shown in the drawings comprises, like the above mentioned barking drum, a horizontal, rotatable drum 1, open at both ends and made of heavy gauge plate. The drum consists of two drum units 3, 5, forming in the embodiment shown, an inlet half and a discharge half, each separately journalled in two pairs of hydrostatic shoe bearings (FIG. 3) which are supported on bases 9 and act on a support ring 11 attached to the drum 1. It is desirable that the drum 1 slopes slightly towards the discharge end 13 so that this is somewhat lower than the inlet end 15, for example the axis of rotation of the drum can form an angle to the horizontal plane of between about 0.5° and about 1.5°. The two drum halves 3, 5 are driven separately by individual motors 17, each motor rotating via a reduction gear 19 (FIGS. 2 and 4) a toothed ring 21 secured to each drum half.

Figure 1:
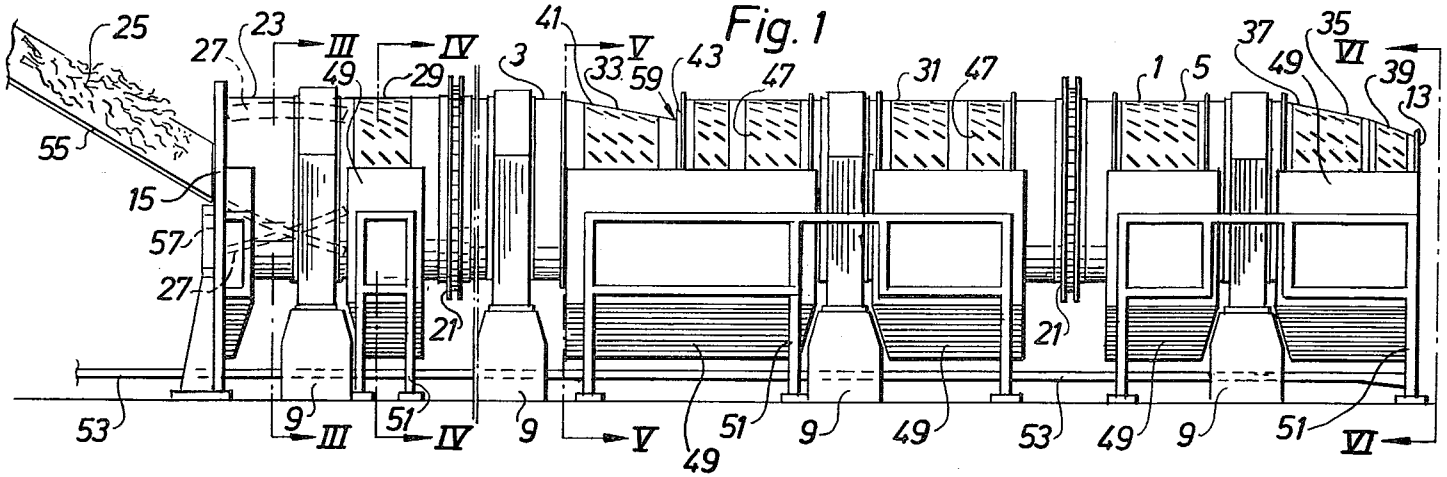
FIG. 1 is a side elevation and FIG. 2 is a plan view of a barking drum constructed in accordance with a preferred embodiment of the invention.
Figure 2:
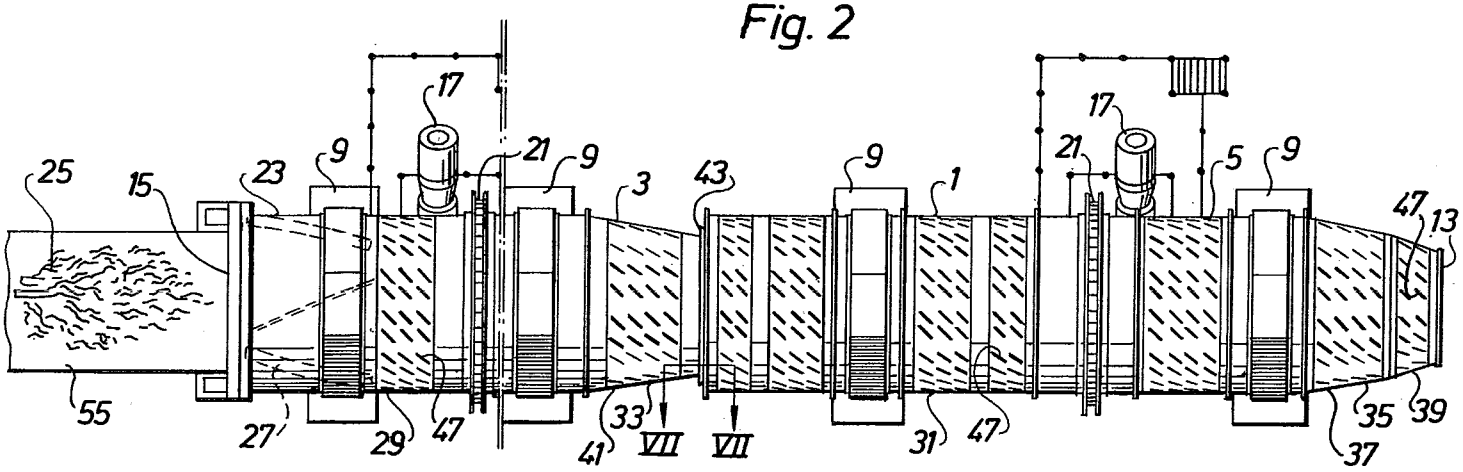

The drum 1 preferably comprises an infeed section 23, provided with internal infeed means for quick feeding-in of the forest raw material 25 into the barking drum 1. The infeed means comprise three substantially radially and helically extending, essentially flat, but arcuate pusher vanes 27 of a plate material attached to the inside of the infeed section 23 and displaced 120° from each other around the circumference, the forest raw material 25 sliding along said pusher vanes into the barking drum. The inclination of the pusher vanes 27 in relation to the axis of rotation of the drum can suitably be 15° to 25°, and the pusher vanes can have a radial height of 0.5 m, for instance. Further, the barking drum includes a first main treatment section 29, located in the inlet half 3 downstream of the infeed section 23, said main treatment section 29 having an elongated cylindrical form of predetermined diameter, as well as a second main treatment section 31, located in the discharge half 5 and having an elongated cylindrical form of the same or substantially the same diameter as the first main treatment section 29. In FIGS. 1 and 2 the downstream parts of the first main treatment section have been omitted. The two drum halves have normally substantially the same length.

According to the invention, the barking drum also comprises a specially designed transition section 33, located between the two main treatment sections 29, 31. The barking drum 1 preferably also includes a conical discharge section 35 located downstream of the second main treatment section 31. The conical discharge section 35 preferably comprises a first portion 37, less conical in shape, and a second orifice portion 39, more conical in shape.

Said transition section 33 comprises a conical portion 41 located downstream of the first main treatment section 29 and adjacent or in the immediate vicinity of the discharge half 5 of the barking drum, and also a specially designed separating means 43 for waste material, arranged upstream of the second main treatment section 31.

The inside of the two cylindrical main treatment sections 29 and 31 of the barking drum, as well as the insides of the conical portion 41 of the transition section and the conical discharge section 35 are provided with a plurality of longitudinal log lifters 45. In the embodiment shown the cylindrical main treatment sections have 12 log lifters 45, whereas the conical portion 41 and the conical discharge section 35 each have 6 log lifters 45. The log lifters may have from substantially L-shaped to semi-circular cross section. Furthermore, the cylindrical main treatment sections 29, 31 and the conical discharge section 35, as well as the conical portion 41 of the transition section 33, are provided with a plurality of bark discharge slots 47 arranged in groups, for the disposal of bark, limbs and other waste material freed in the drum during treatment of the forest raw material, the slots 47 being inclined in relation to the log lifters and the axis of rotation of the drum. Below each group of slots 47 is a collecting hopper 49 supported by a framework 51. The collecting hoppers 49 (not shown in FIG. 2) discharge onto a suitable conveyor, e.g. a belt conveyor 53, for removal of the waste material.

An inclined chute 55 is arranged at the inlet end 15 of the barking drum, for supplying forest raw material 25 to the barking drum, the bottom of the chute 55 at the inlet end 15 being located slightly below the axis of rotation of the drum 1. The part of the inlet opening located below the chute 55 is screened by a transverse plate 57 to ensure that the forest raw material supplied cannot drop out of the inlet end of the drum.

Figure 8:
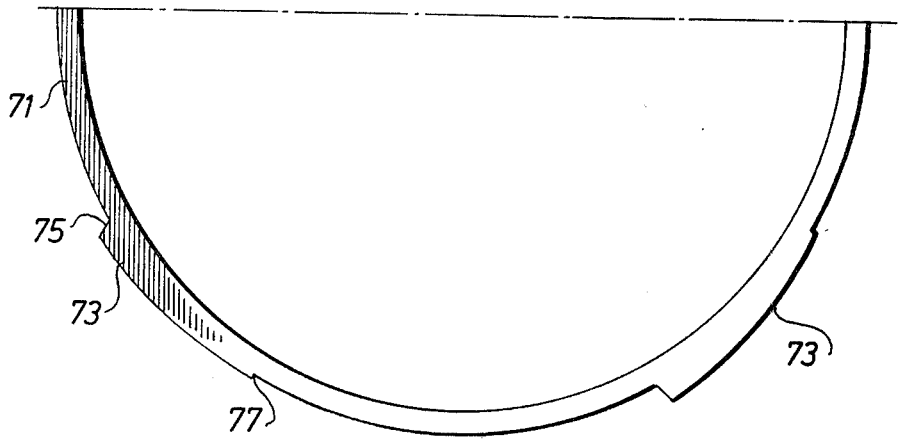
FIG. 8 is an end view of a part of a clearing means arranged in the transition section according to FIG. 7.

The above mentioned separating means 43 comprises an annular outlet or drainage opening 59 of predetermined size, permitting the desired continuous discharging of even the coarser waste material such as long strips of barks and limbs as well as needles and leaves. The outlet opening 59 is located in the vertical dividing plane between the inlet half 3 and the discharge half 5 of the barking drum and is generally limited by the opposite ends of the inlet and discharge halves. Further, said separating means comprises an arresting or catching means 61 located in the discharge half 5 close to the drainage opening and mounted to catch or arrest and guide the waste material out through the outlet opening 59. The arresting means 61 has an annular arresting or retaining surface 63 facing to the direction of feed of the forest raw material. In the preferred embodiment shown, a portion 65 of said arresting surface is arranged radially inside the downstream end of the inlet half. The arresting means suitably consists of a conical plate, secured to an annular plate 67 at the end of the discharge half and is supported by an annular plate 69 welded to the inside of the barking drum. In the embodiment shown the separating means 43 also includes a clearing means 71 in the form of a ring secured to the end of the conical portion 41 of the inlet half and provided with a plurality of segments 73, for example 4 segments, located in the outlet opening 59, as is shown in FIG. 8. The diameter of each segment 73 decreases from the front end 75 to the rear end 77 of the segment, seen in relation to the direction of rotation of the ring. Since the two drum halves 3, 5 rotate at slightly different speeds, the segments 73 will effectively clear the outlet opening 59, thus increasing the discharge capacity. Furthermore, some form of knife arrangement may be provided in the outlet opening 59 to cut off long strips of bark and limbs. Thus, the front end of each segment may be formed as a cutting edge, for instance.

A barking drum designed in the manner described above for use as a combined drum for treating both full trees (trees without root system) and roundwood as well as for wood like eucalyptus, from which the bark is difficult to remove, has two cylindrical main treatment sections 29, 31 each with a constant diameter of 5 m and a length of about 15.4 m, a conical portion 33 downstream of the first main treatment section, having a diameter decreasing from 5 m to 3 m over a length of about 3.1 m, and a conical discharge section 35 with a diamter decreasing from 5 m to 3 m over a length of about 3.7 m. The outlet opening 59 in the dividing plane between the drum halves has a maximum width of 10 cm and the conical plate has an arresting surface inclined 45°, the upper edge of the conical plate being located radially inside the inner opening edge of the conical portion so that the radial distance is 30 cm. The segments 73 have a chord length of about 1.1 m and a maximum width of 10 cm.

A barking drum of the type described above is excellent for limbing and barking full trees, especially wood from thinning stands, which are preferably fed in in bundles. However, the barking drum can also be used advantageously for barking roundwood and even for barking wood such as eucalyptus from which the bark is difficult to remove. When barking and limbing full trees the substantial separation of limbs and branches is effected in the first main treatment section. The conical portion 41 of the transition section has several functions. It enables an optimum degree of filling to be achieved in the first main treatment section and a decrease in the movement of the wood, due to the fewer number of log lifters so that the waste material is collected to a greater extent in the lower region before the wood is transferred to the second drum half. At the same time, the conical portion provides a natural connection to the second drum half and enables the arrangement of a separating means 43 as described above. A conical discharge section 35 according to the invention also has several functions. It enables an optimum degree of filling to be achieved in the second main treatment section also, without the need for special end screening, such as a sliding gate, against which the edges of the logs are pressed. Such a sliding gate incurs increased breakage of smallwood. The use of a conical discharge section completely open at the end, enables the wood to be fed out in an improved manner without any breakage.

The arrangement of a special separating means 43 with an arresting or catching means 61 and cooperating outlet or drainage opening 59 results in considerable advantages as to improved capacity and result of treatment. The arresting means 61 lifts the wood to be passed to the following drum half 5 so that a special space is formed for the waste material below the wood in the transition section. The bark and other waste material which have previously been unable to pass out through the slots 47 in the first drum half, therefore have a much greater chance of being discharged out of the drum via the annular outlet opening 59. This discharging is in turn possible since the loose bark and other loose waste material are prevented by the arresting means from being drawn down to the next drum half since the inner diameter of the conical arresting means at its downstream end is less, e.g. 60 cm, than the inner diameter of the opening of the conical portion. Since the loose waste material freed from the wood in the first main treatment section and moved into the transition section, is not drawn into the second main treatment section, there are improved chances of the remaining bark being effectively loosened due to the absence of previously removed waste material the remaining bark will be favorably subjected to a higher pressure when the surfaces of the wood strike each other. This results in an essential increase of the degree of barking.

The slots 47 in the drum can advantageously be adjusted for treating roundwood since, when treating full tree limbs and bark can be separated through the slots and the separating means 43. The slots 47 can thereby be sufficiently narrow to prevent smallwood from passing through. The separating member 43 with its outlet opening 59 also gives satisfactory discharge of long strips of bark, particularly when barking eucalyptus.

In a modified barking drum composed of three or more drum units aligned axially one after the other, a separating means according to the invention is preferably arranged in each transition section formed at the end portions of two adjacent drum units.

An alternative or supplementary clearing means can be arranged stationarily in the vicinity of the vertical dividing plane between two drum units, and free from the drum, said clearing means comprises a clearing arm of suitable form extending into the drainage opening to clear this during rotation of the drum in relation to the stationary clearing arm. The clearing means can also be arranged movable and free from the drum, in which case a clearing arm extends into the outlet opening and is reciprocating in a circle arc. Such clearing means can be mounted below or at the side of the drum, particularly within the quarter of the circumference of the drainage opening which normally receives the waste material.

When treating full trees the drum units rotate in the same direction at a speed of about 7 rpm, whereas roundwood is treated at a slightly lower speed, e.g. 5 rpm. The speed of rotation of the two drum units normally differs by about 1 rpm, for instance, which is favourable for the function of the clearing means shown.

The waste material in the form of limbs, bark, needles, leaves discharged through the drum slots and the drainage opening, is used for firing purposes.

In the drawings and specification, there has been set forth a preferred embodiment of the invention, and although specific terms are employed, they are used in a generic and descriptive sense only and not for purposes of limitation.

What we claim is:

1. A barking drum for removing waste material, such as limbs and bark, from forest raw material being fed through said drum, said drum comprising a horizontal, rotating drum open at both ends and supported by bearings, said drum having a plurality of log lifters arranged inside the drum and extending along the axis of the drum, and a plurality of slots arranged around and along the drum for the discharging of waste material being freed from forest raw material under treatment in the drum, said drum comprising two or more axially aligned drum units each comprising a main treatment section, wherein two drum units arranged after each other have end sections facing each other and comprising a transition section, said transition section comprising a separating means including an arresting means and an annular outlet opening cooperating with said arresting means, said outlet opening being arranged in the dividing plane between said two drum units, for discharging waste material caught by said arresting means.

2. A barking drum according to claim 1 wherein said arresting means has an arresting surface facing the forest raw material, said surface being substantially conical.

3. A barking drum according to claim 1 or 2 wherein said arresting means has an inner edge the diameter of which is less than the diameter of the opening of the opposite drum unit.

4. A barking drum according to claim 3 wherein the difference between said two diameters is between about 0.1 m and 1 m.

5. A barking drum according to claim 1 wherein said two cylindrical main treatment sections have substantially the same diameter, said transition section located between said main treatment sections comprising a conical section tapering in the direction of feed of the forest raw material and forming the opening of the upstream drum unit at said dividing plane.

6. A barking drum according to claim 1 wherein said separating means comprises a clearing means for the outlet opening, said clearing means being arranged at the opening of the upstream drum unit.

7. A barking drum according to claim 6 wherein said clearing means comprises a ring member having a plurality of segments arranged around its periphery.

8. A barking drum according to claim 1 wherein said annular outlet opening has a width of between about 5 cm and about 15 cm.

9. A barking drum according to claim 1 also comprising a conical discharge section tapering towards the discharge opening and arranged to provide the desired degree of filling in the downstream drum unit.

10. A method for removing waste material, such as limbs and bark, from forest raw material in a rotary barking drum, said method comprising feeding the forest raw material into a first treatment section of the barking drum while rotating the first treatment section so as to tumble the forest raw material and loosen waste material such as limbs and bark from the forest raw material, advancing the forest raw material from the first treatment section to a second treatment section of the barking drum while rotating the second treatment section so as to tumble the forest raw material and further loosen waste material therefrom, and while arresting the waste material removed from the forest raw material in the first treatment section and preventing its passage with the forest raw material to the second treatment zone, and discharging the thus arrested waste material from the barking drum through an outlet opening provided at the junction between the first and second treatment sections.

11. A method according to claim 10 wherein the first and second treatment sections are rotated in the same direction but at different speeds.

12. A method according to claim 10 also including continuously clearing the outlet opening to keep the opening open for the discharge of waste material.

13. A method for removing waste material, such as limbs and bark, from forest raw material in a rotary barking drum having a plurality of log lifters arranged inside the drum and extending along the axis of the drum, and a plurality of slots arranged around and along the drum for the discharging of waste material being freed from the forest raw material under treatment in the drum, said method comprising: feeding the forest raw material into a first treatment section of the barking drum while rotating the first treatment section and engaging the forest raw material therein with the log lifters so as to loosen waste materials such as limbs and bark from the forest raw material; advancing the forest raw material from the first treatment section, through a transition section and to a second treatment section of the barking drum while rotating the second treatment section and engaging the forest raw material therein with the log lifters so as to further loosen waste material from the forest raw material; arresting in the transition zone the waste material removed from the forest raw material in the first treatment section and preventing its passage with the forest raw material to the second treatment zone; and discharging the thus retained waste material from the drum through an annular outlet opening provided at the junction between said first and second treatment sections.

* * * * *